US012501931B2

(12) United States Patent
Cowan

(10) Patent No.: US 12,501,931 B2
(45) Date of Patent: Dec. 23, 2025

(54) SMOKING SUBSTITUTE COMPONENT

(71) Applicant: Imperial Tobacco Limited

(72) Inventor: Dean Cowan, Liverpool (GB)

(73) Assignee: Imperial Tobacco Limited, Bristol (GB)

( * ) Notice: Subject to any disclaimer, the term of this patent is extended or adjusted under 35 U.S.C. 154(b) by 513 days.

(21) Appl. No.: 17/818,545

(22) Filed: Aug. 9, 2022

(65) Prior Publication Data

US 2022/0378093 A1 Dec. 1, 2022

Related U.S. Application Data

(63) Continuation of application No. PCT/EP2021/053521, filed on Feb. 12, 2021.

(30) Foreign Application Priority Data

Feb. 13, 2020 (EP) ..... 20157080

(51) Int. Cl.

| | |
|---|---|
| ***A24F 40/40*** | (2020.01) |
| ***A24F 40/10*** | (2020.01) |
| ***A24F 40/46*** | (2020.01) |
| ***A24F 40/50*** | (2020.01) |

(52) U.S. Cl.

CPC ..... *A24F 40/40* (2020.01); *A24F 40/10* (2020.01); *A24F 40/50* (2020.01)

(58) Field of Classification Search

None

See application file for complete search history.

(56) References Cited

U.S. PATENT DOCUMENTS

| | | | | |
|---|---|---|---|---|
| 2018/0177240 | A1 | 6/2018 | Duque et al. | |
| 2019/0000143 | A1* | 1/2019 | Zhu | A24F 40/485 |
| 2019/0174828 | A1* | 6/2019 | Holtz | A24F 40/46 |
| 2019/0350256 | A1 | 11/2019 | Hejazi | |

FOREIGN PATENT DOCUMENTS

| | | | |
|---|---|---|---|
| WO | WO 2018/024004 | A1 | 2/2018 |
| WO | WO 2018/161254 | A1 | 9/2018 |
| WO | WO 2018/228121 | A1 | 12/2018 |
| WO | WO 2019/052748 | A1 | 3/2019 |
| WO | WO 2019/206900 | A1 | 10/2019 |

OTHER PUBLICATIONS

WO 2018228121 A1, English translation obtained from Espacenet, pp. 1-9 (Year: 2018).*

International Search Report and Written Opinion (PCT/EP2021/053521), dated May 11, 2021, 13 pages.

European Search Report (20157080.1-1004), dated Sep. 10, 2020, 7 pages.

* cited by examiner

*Primary Examiner* — Philip Y Louie

*Assistant Examiner* — Madeleine P Delacruz

(74) *Attorney, Agent, or Firm* — DUNLAP CODDING, P.C.

(57) ABSTRACT

Disclosed is an aerosol-delivery component comprising a vaporiser and having an airflow path extending from at least one upstream air inlet to a downstream air outlet. The airflow path comprises a vaporiser portion extending past (e.g., through a hole in) the vaporiser. The vaporiser portion of the airflow path is at least partly defined by an air tube, e.g., a metal air tube. The air tube has an inlet in fluid communication with the at least one air inlet, and an outlet which is downstream of the vaporiser.

15 Claims, 5 Drawing Sheets

SMOKING SUBSTITUTE COMPONENT

CROSS-REFERENCE TO RELATED APPLICATIONS/INCORPORATION BY REFERENCE STATEMENT

This application is a non-provisional application claiming benefit to the international application no. PCT/EP2021/053521 filed on Feb. 12, 2021, which claims priority to EP 20157080.1 filed on Feb. 13, 2020. The entire contents of each of the above-referenced applications are hereby incorporated herein by reference in their entirety.

FIELD OF THE DISCLOSURE

The present disclosure relates to an aerosol-delivery component, which may be a consumable for receipt in an aerosol-delivery device to form an aerosol-delivery system (e.g., a smoking substitute system).

BACKGROUND

The smoking of tobacco is generally considered to expose a smoker to potentially harmful substances. It is generally thought that a significant amount of the potentially harmful substances are generated through the heat caused by the burning and/or combustion of the tobacco and the constituents of the burnt tobacco in the tobacco smoke itself.

Combustion of organic material such as tobacco is known to produce tar and other potentially harmful by-products. There have been proposed various smoking substitute systems in order to avoid the smoking of tobacco.

Such smoking substitute systems can form part of nicotine replacement therapies aimed at people who wish to stop smoking and overcome a dependence on nicotine.

Smoking substitute systems, which may also be known as electronic nicotine delivery systems, may comprise electronic systems that permit a user to simulate the act of smoking by producing an aerosol, also referred to as a "vapour", which is drawn into the lungs through the mouth (inhaled) and then exhaled. The inhaled aerosol typically bears nicotine and/or flavourings without, or with fewer of, the odour and health risks associated with traditional smoking.

In general, smoking substitute systems are intended to provide a substitute for the rituals of smoking, whilst providing the user with a similar experience and satisfaction to those experienced with traditional smoking and tobacco products.

The popularity and use of smoking substitute systems has grown rapidly in the past few years. Although originally marketed as an aid to assist habitual smokers wishing to quit tobacco smoking, consumers are increasingly viewing smoking substitute systems as desirable lifestyle accessories. Some smoking substitute systems are designed to resemble a traditional cigarette and are cylindrical in form with a mouthpiece at one end. Other smoking substitute systems do not generally resemble a cigarette (for example, the smoking substitute device may have a generally box-like form).

There are a number of different categories of smoking substitute systems, each utilising a different smoking substitute approach. A smoking substitute approach corresponds to the manner in which the substitute system operates for a user.

One approach for a smoking substitute system is the so-called "vaping" approach, in which a vaporisable liquid, typically referred to (and referred to herein) as "e-liquid", is heated by a heater to produce an aerosol vapour which is inhaled by a user. An e-liquid typically includes a base liquid as well as nicotine and/or flavourings. The resulting vapour therefore typically contains nicotine and/or flavourings. The base liquid may include propylene glycol and/or vegetable glycerine.

A typical vaping smoking substitute system includes a mouthpiece, a power source (typically a battery), a tank or liquid reservoir for containing e-liquid, as well as a heater. In use, electrical energy is supplied from the power source to the heater, which heats the e-liquid to produce an aerosol (or "vapour") which is inhaled by a user through the mouthpiece.

Vaping smoking substitute systems can be configured in a variety of ways. For example, there are "closed system" vaping smoking substitute systems which typically have a heater and a sealed tank which is pre-filled with e-liquid and is not intended to be refilled by an end user. One subset of closed system vaping smoking substitute systems includes a device which includes the power source, wherein the device is configured to be physically and electrically coupled to a consumable component including the tank and the heater. In this way, when the tank of the consumable component has been emptied, the device can be reused by connecting it to a new consumable component. Another subset of closed system vaping smoking substitute systems are completely disposable, and intended for one-use only.

There are also "open system" vaping smoking substitute systems which typically have a tank that is configured to be refilled by a user, so the system can be used multiple times.

An example vaping smoking substitute system is the Myblu™ e-cigarette. The Myblu™ e cigarette is a closed system which includes a device and a consumable component. The device and consumable component are physically and electrically coupled together by pushing the consumable component into the device. The device includes a rechargeable battery. The consumable component includes a mouthpiece, a sealed tank which contains e-liquid, as well as a vaporiser, which for this system is a heating filament coiled around a portion of a wick which is partially immersed in the e-liquid. The system is activated when a microprocessor on board the device detects a user inhaling through the mouthpiece. When the system is activated, electrical energy is supplied from the power source to the vaporiser, which heats e-liquid from the tank to produce a vapour.

As the vapour passes through the consumable component (entrained in the airflow) from the location of vaporization to an outlet of the consumable (e.g., a mouthpiece), the vapour cools and condenses to form an aerosol for inhalation by the user. The aerosol may contain nicotine and/or flavour compounds.

Leakage of unvaporised e-liquid from the consumable component is undesirable as it leads to wastage of e-liquid and contamination of the user/user's belongings. Undesirable leakage has been observed from air inlets in the base of the consumable component as these air inlets lead directly to a vaporising chamber housing the e-liquid soaked wick.

There is the need to ameliorate this problem by reducing leakage.

BRIEF SUMMARY

According to a first aspect there is a provided an aerosol-delivery component, comprising: a vaporiser and having an airflow path extending from at least one upstream air inlet to a downstream air outlet, wherein the airflow path comprises a vaporiser portion extending past the vaporiser, the vaporiser portion of the airflow path being at least partly defined by an air tube, the air tube having an inlet in fluid communication with the at least one air inlet and an outlet, wherein the air tube outlet is downstream of the vaporiser.

By providing an air tube which defines the airflow path past the vaporiser and has an outlet downstream of the vaporiser, unvaporised e-liquid from the vaporiser is less likely to pass to and thus out of the air inlet(s) in the component. In other words, by extending past the vaporiser, the vaporiser portion of the airflow path fully bypasses the vaporiser, such that airflow in the vaporiser portion is physically separated from the vaporiser and any unvaporised e-liquid on or at the vaporiser. The location of the air tube outlet downstream of the vaporiser means that unvaporised e-liquid is less likely to pass into the air tube through the outlet (and, consequently, is less likely to then pass out of the at least one air inlet of the component).

As the airflow continues from the outlet of the air tube to the component air outlet, vaporised e-liquid in pulled into the airflow path downstream of the air tube outlet towards the component air outlet for inhalation by the user.

References to "downstream" in relation to the airflow path are intended to refer to the direction towards the air outlet. Conversely, references to "upstream" are intended to refer to the direction towards the air inlet.

Optional features will now be set out. These are applicable singly or in any combination with any aspect.

The airflow path comprises a first portion extending from the at least one air inlet to the inlet of the air tube, e.g., extending through a component base from the air inlet to the inlet of the air tube. A second (vaporiser) portion of the airflow path extends within the air tube (from the air tube inlet to the air tube outlet) and a third portion extends from the air tube outlet to the component air outlet.

The vaporiser portion may be fully defined by the air tube (i.e., the air tube may extend past the vaporiser).

The second (vaporiser) and third portions of the airflow path through the component may generally linear, i.e., extending in a substantially longitudinal direction through the component within the air tube and then on to the air outlet. The second (vaporiser) and third portions of the airflow path may extend along the axial centre of the component.

In some embodiments, the first portion of the airflow path (from the component air inlet to the inlet of the air tube) may also be generally linear/generally axial such that it is substantially linearly/axially aligned with the second (vaporiser) and third portions, i.e., the entire airflow path may be generally linear/axial.

In these embodiments the at least one component air inlet may comprise a central air inlet (e.g., provided at the axial centre of the component base). The air tube may extend within the base towards the air inlet.

In some embodiments, the component further comprises at least one further air inlet and at least one further airflow path extending from the at least one further air inlet and past the vaporiser. For example, there may be two further air inlets, which may be diametrically opposed across the central air inlet.

The/each further airflow path may comprise a radial portion that extends along a surface, e.g., along an upstream surface of the vaporiser. The/each further airflow path may comprise a vaporiser portion that extends past the vaporiser.

The/each further air flow path may comprise at least one deflection. For example, the/each further airflow path may comprise an upstream longitudinal portion extending from the respective further air inlet, a first deflection (e.g., a 90° deflection) to the radial portion and then a second deflection (e.g., a 90° deflection) to a vaporiser portion which passes the vaporiser. The vaporiser portion of the further airflow path(s) may extend past the vaporiser substantially parallel to the airflow through the air tube (i.e., substantially parallel to the vaporiser portion of the air flow path). The further airflow paths(s) may join the airflow path downstream of the outlet of the air tube.

The component may comprise a conduit that extends towards the air outlet from a conduit opening proximal the vaporiser. The conduit may extend along the axial centre of the component.

The air tube outlet may be coincident with the conduit opening or may be within the conduit. For example, a downstream portion of the air tube may extend (e.g., concentrically) within an upstream portion of the conduit.

The air outlet is provided in an outlet portion, e.g., an outlet portion of a component housing. The outlet portion may comprise a transverse outlet portion (substantially perpendicular to the component axis) in which the air outlet may be formed.

The air outlet/outlet portion may be provided at a first lateral end of the housing.

The housing further comprises one or more side walls (e.g., laterally opposed first and second side walls) depending longitudinally from a transverse portion of the outlet portion. The side walls may be integrally formed with the transverse outlet portion of the component housing.

The housing may further comprise opposing front and rear walls spaced by the laterally opposed first and second side walls. The distance between the first and second side walls of the housing may define a width of the housing. The distance between the front and rear walls may define a depth of the housing. The width of the housing may be greater than the depth of the housing.

The conduit (extending from proximal the vaporiser to the air outlet) may depend longitudinally from the outlet portion, e.g., from the transverse portion of the outlet portion.

The conduit may be substantially parallel to the housing first and second side walls.

The length of the housing may be greater than the width of the housing. The depth of the housing may be smaller than each of the width and the length.

The component may comprise a tank for housing the aerosol precursor (e.g., a liquid aerosol precursor). The aerosol precursor may comprise an e-liquid, for example, comprising a base liquid and, e.g., nicotine. The base liquid may include propylene glycol and/or vegetable glycerine. Hence, the component may be a vaping smoking substitute component.

The tank (e.g., an outer region of the tank) may be defined between the housing walls, e.g., the first and second side walls and the front/rear walls.

At least a portion of one of the housing walls defining the tank may be translucent or transparent.

The conduit may extend through the tank with the conduit walls defining an inner region of the tank.

The upper region of the tank may be defined by the transverse portion of the outlet portion of the component housing.

A lower region of the tank is in fluid communication with the vaporiser (e.g., with the substrate) such that aerosol precursor from the tank can permeate the vaporiser/substrate.

References to "upper", "lower", "above" or "below" are intended to refer to the component when in an upright/ vertical orientation, i.e., with elongate (longitudinal/length) axis of the component vertically aligned and with the outlet portion vertically uppermost and the base lowermost.

As discussed above, the airflow path passes the vaporiser (within the air tube) between the air inlet and the air outlet. The vaporiser may comprise a heating element for heating a substrate.

The substrate may be a porous substrate, e.g., a porous ceramic substrate. The substrate may be a planar substrate. It may extend transversely across component between the first and second side walls of the housing. It may also extend between the front and rear walls of the housing.

The heating element may be a conductive track, e.g., a metal conductive track which may be mounted or screen printed onto the substrate. The heating element, e.g., the conductive track may be mounted/screen printed on the upstream side of the substrate, e.g., on the upstream surface of the planar substrate.

The radial portion(s) of the further airflow path(s) may be partly defined by the upstream side/surface of the substrate so that air passes over the upstream side/surface of the substrate to entrain vaporised e-liquid.

The substrate may comprise a longitudinal through hole, e.g., a central longitudinal through hole through which the air tube passes. The air tube may be formed of metal. This may increase its durability in proximity to the heater element.

The vaporiser portion(s) of the further airflow path(s) may extend through the substrate, e.g., through one or more through holes in the substrate such as through the central through hole in the substrate. For example, there may be a gap, e.g., an annular gap through the through hole around the air tube.

The vaporiser portion(s) of the further airflow path(s) may join the airflow path within the conduit. In this way, the (cooler) air from the air tube will mix with the (hotter) vapour-laden air from the further airflow path(s) and this may impact, e.g., increase, the particle size within the resulting aerosol for inhalation at the air outlet.

The heating element may be electrically connectable (or connected) to a power source. Thus, in operation, the power source may supply electricity to (i.e., apply a voltage across) the heating element so as to heat the heating element.

The component base is provided at a second lateral end of the component and defines the first portion of the airflow path (from the air inlet to the air tube). The upstream longitudinal portions of the further airflow paths(s) may also extend through the base portion. The base portion may comprise a support surface on which the substrate is supported. The radial portion(s) of the further airflow path(s) may be defined within the support surface. The component base may further comprise a sleeve portion upstanding from the support surface which abuts the perimeter of the substrate. The sleeve portion may further seal against the walls of the lower portion of the component housing.

The component may further comprise a sealing plate with the substrate interposed between the base and the sealing plate.

The substrate may be coated with a deformable layer, e.g., a silicone layer.

The sealing plate may seal against the walls of the lower portion of the housing to form the lower end of the tank. It may engage with the base, e.g., with the sleeve portion of the base. The sealing plate may comprise at least one feed channel in fluid communication with the tank and extending to the substrate to provide the aerosol precursor (e-liquid) to the substrate. The downstream surface of the substrate may comprise at least one well in fluid communication with a respective feed channel for pooling of aerosol precursor (e-liquid).

The sealing plate may further comprise a gasket for sealing against the conduit proximal the conduit opening.

In some embodiments, the component further comprises a mouthpiece portion which is connected to the outlet portion of the component housing.

The mouthpiece portion comprises a mouthpiece aperture which is in fluid communication with the air outlet on the outlet portion of the component housing.

The mouthpiece portion and component housing may comprise cooperating features for securing the portion to the outlet portion. For example, the mouthpiece portion may comprise recesses or apertures for receiving tabs provided on the side walls of the housing proximal the outlet portion.

An absorbent member may be interposed between the mouthpiece portion and the outlet portion of the component housing.

In a second aspect there is provided an aerosol-delivery system (e.g., a smoking substitute system) comprising a component according to the first aspect and an aerosol-delivery (e.g., smoking substitute) device.

The component may be an aerosol-delivery (e.g., a smoking substitute) consumable, i.e., in some embodiments the component may be a consumable component for engagement with the aerosol-delivery (e.g., a smoking substitute) device to form the aerosol-delivery (e.g., s smoking substitute) system.

The device may be configured to receive the consumable component. The device and the consumable component may be configured to be physically coupled together. For example, the consumable component may be at least partially received in a recess of the device, such that there is snap engagement between the device and the consumable component. Alternatively, the device and the consumable component may be physically coupled together by screwing one onto the other, or through a bayonet fitting.

Thus, the consumable component may comprise one or more engagement portions for engaging with the device.

The consumable component may comprise an electrical interface for interfacing with a corresponding electrical interface of the device. One or both of the electrical interfaces may include one or more electrical contacts (which may extend through the base). Thus, when the device is engaged with the consumable component, the electrical interface may be configured to transfer electrical power from the power source to the heating element of the consumable component. The electrical interface may also be used to identify the consumable component from a list of known types. The electrical interface may additionally or alternatively be used to identify when the consumable component is connected to the device.

The device may alternatively or additionally be able to detect information about the consumable component via an RFID reader, a barcode or QR code reader. This interface may be able to identify a characteristic (e.g., a type) of the consumable. In this respect, the consumable component may include any one or more of an RFID chip, a barcode or QR code, or memory within which is an identifier and which can be interrogated via the interface.

In other embodiments, the component may be integrally formed with the aerosol-delivery (e.g., a smoking substitute) device to form the aerosol-delivery (e.g., s smoking substitute) system.

In such embodiments, the aerosol former (e.g., e-liquid) may be replenished by re-filling a tank that is integral with the device (rather than replacing the consumable). Access to the tank (for re-filling of the e-liquid) may be provided via, e.g., an opening to the tank that is sealable with a closure (e.g., a cap).

Further features of the device are described below. These are applicable to both the device for receiving a consumable component and to the device integral with the component.

The device may comprise a power source. The device may comprise a controller.

A memory may be provided and may be operatively connected to the controller. The memory may include non-volatile memory. The memory may include instructions which, when implemented, cause the controller to perform certain tasks or steps of a method. The device may comprise a wireless interface, which may be configured to communicate wirelessly with another device, for example a mobile device, e.g., via Bluetooth®. To this end, the wireless interface could include a Bluetooth® antenna. Other wireless communication interfaces, e.g., WiFi®, are also possible. The wireless interface may also be configured to communicate wirelessly with a remote server.

An airflow (i.e., puff) sensor may be provided that is configured to detect a puff (i.e., inhalation from a user). The airflow sensor may be operatively connected to the controller so as to be able to provide a signal to the controller that is indicative of a puff state (i.e., puffing or not puffing). The airflow sensor may, for example, be in the form of a pressure sensor or an acoustic sensor. The controller may control power supply to a heating element in response to airflow detection by the sensor. The control may be in the form of activation of the heating element in response to a detected airflow. The airflow sensor may form part of the device.

In a third aspect there is provided a method of using the aerosol-delivery (e.g., smoking substitute) consumable component according to the first aspect, the method comprising engaging the consumable component with an aerosol-delivery (e.g., smoking substitute) device (as described above) having a power source so as to electrically connect the power source to the consumable component (i.e., to the vaporiser of the consumable component).

The disclosure includes the combination of the aspects and preferred features described except where such a combination is clearly impermissible or expressly avoided.

BRIEF DESCRIPTION OF THE DRAWINGS

So that further aspects and features thereof may be appreciated, embodiments will now be discussed in further detail with reference to the accompanying figures, in which.

DETAILED DESCRIPTION

Aspects and embodiments will now be discussed with reference to the accompanying figures. Further aspects and embodiments will be apparent to those skilled in the art.

Figure 1A:
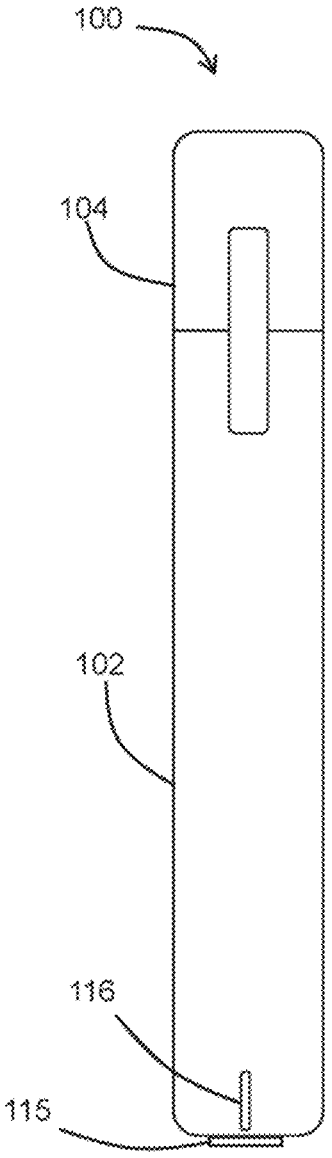
FIG. 1A is a front schematic view of an exemplary embodiment of a smoking substitute system.
Figure 1B:
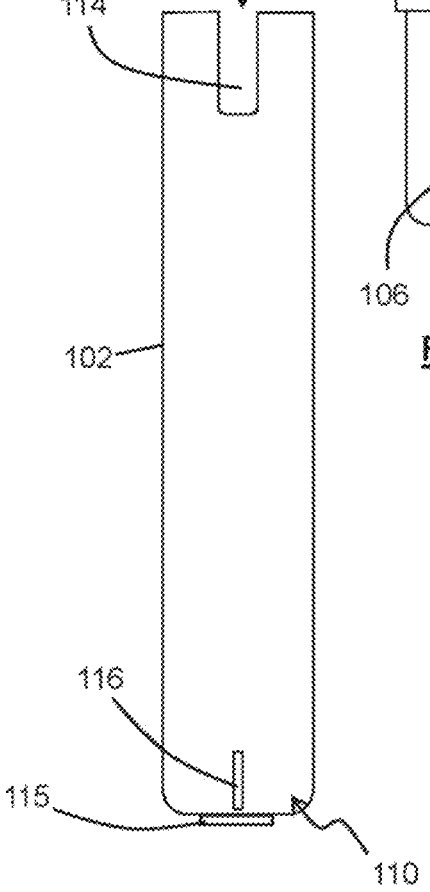
FIG. 1B is a front schematic view of an exemplary embodiment of a device of the system.

FIG. 1A shows a smoking substitute system 100. In this example, the smoking substitute system 100 includes a device 102 and an aerosol delivery consumable component 104. The consumable component 104 may alternatively be referred to as a "pod", "cartridge" or "cartomizer". It should be appreciated that in other examples (i.e., open systems), the device may be integral with the component. In such systems, a tank of the aerosol delivery component may be accessible for refilling the system.

Figure 1C:
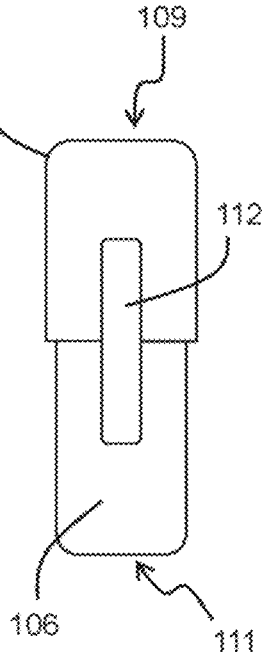
FIG. 1C is a front schematic view of an exemplary embodiment of a consumable of the system.

In this example, the smoking substitute system 100 is a closed system vaping system, wherein the consumable component 104 includes a sealed tank and is intended for single-use only. The consumable component 104 is removably engageable with the device 101 (i.e., for removal and replacement). FIG. 1A shows the smoking substitute system 100 with the device 102 physically coupled to the consumable component 104, FIG. 18 shows the device 102 of the smoking substitute system 100 without the consumable component 104, and FIG. 1C shows the consumable component 104 of the smoking substitute system 100 without the device 101.

The device 102 and the consumable component 104 are configured to be physically coupled together by pushing the consumable component 104 into a cavity at an upper end 108 of the device 102, such that there is an interference fit between the device 102 and the consumable component 104. In other examples, the device 102 and the consumable component 104 may be coupled by screwing one onto the other, or through a bayonet fitting.

The consumable component 104 comprises a housing 106 having a base portion 111 (at a lower end), an outlet portion 109 (at an upper end), and walls extending longitudinally from the base portion 111 to the outlet portion 109. In particular, the consumable component 104 comprises front and rear walls spaced by opposing first and second side walls. The distance between the front and rear walls defines a depth of the housing 106 and the distance between the side walls defines a width of the housing 106. The width of the housing 106 is greater than the depth of the housing 106.

The tank 106 of the consumable component 104 comprises a window 112, which allows the quantity of e-liquid remaining in the tank to be visually assessed. The device 102 includes a slot 114 so that the window 112 of the consumable component 104 can be seen whilst the rest of the tank is obscured from view when the consumable component 104 is inserted into the cavity at the upper end 108 of the device 102.

A lower end of the device 102 includes a light 116 (e.g., an LED) located behind a small translucent cover. The light 116 may be configured to illuminate when the smoking substitute system 100 is activated. Whilst not shown, the consumable component 104 may identify itself to the device 102, via an electrical interface, RFID chip, or barcode.

Figure 2A:
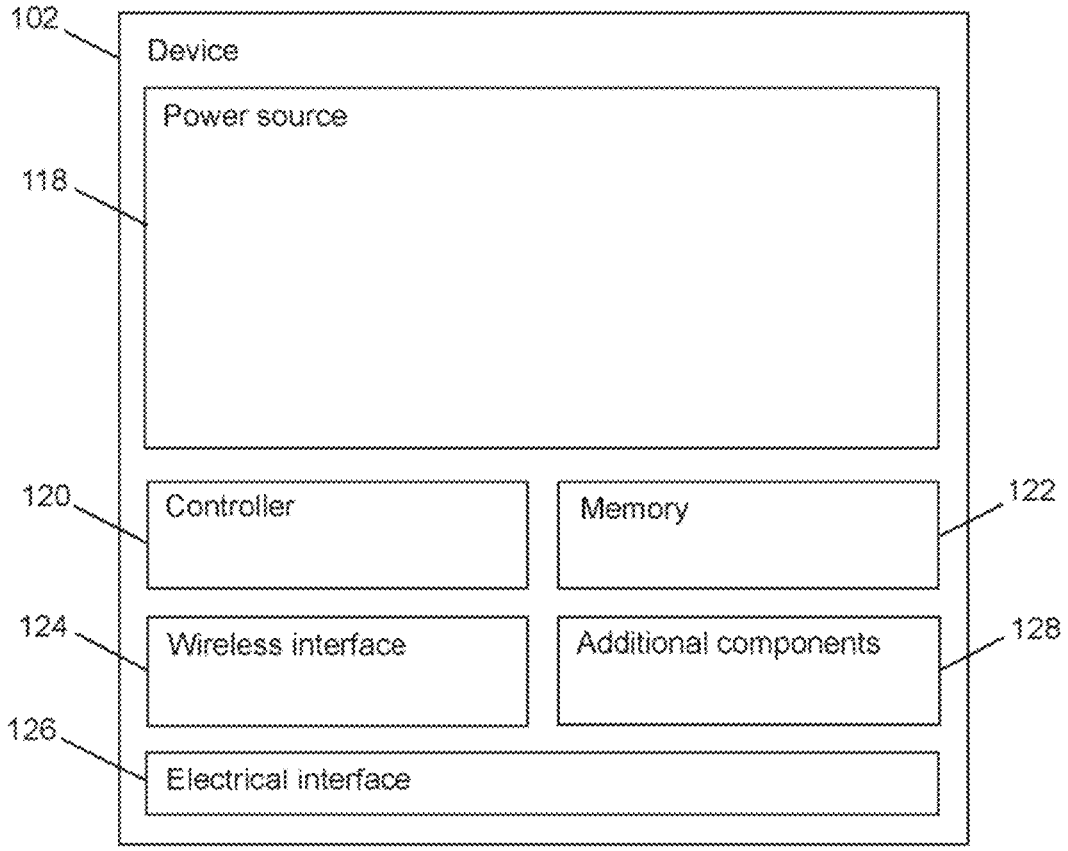
FIG. 2A is a schematic of an exemplary embodiment of the components of the device.
Figure 2B:
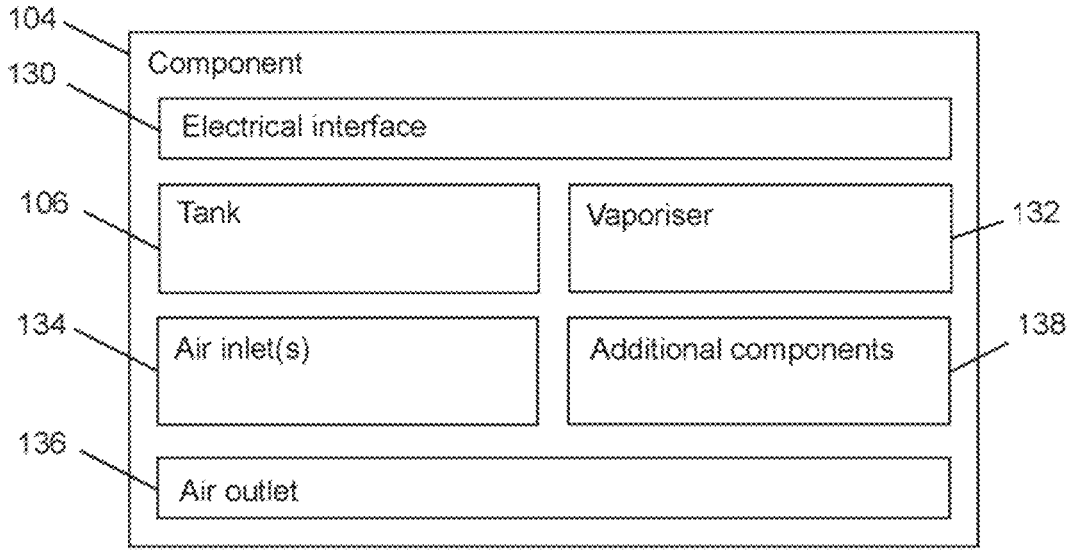
FIG. 2B is a schematic of an exemplary embodiment of the components of the consumable.

FIGS. 2A and 2B are schematic drawings of the device 102 and consumable component 104. These figures provide an overview of the components that form part of the consumable component 104 and device 102. As is apparent from FIG. 2A, the device 102 includes a power source 118, a controller 120, a memory 122, a wireless interface 124, an electrical interface 126, and, optionally, one or more additional components 128.

The power source 118 is a battery (e.g., a rechargeable battery). The controller 120 may, for example, include a microprocessor. The memory 122 may include non-volatile memory. The memory 122 may include instructions which, when implemented, cause the controller 120 to perform certain tasks or steps of a method.

The wireless interface 124 may be configured to communicate wirelessly with another device, for example a mobile device, e.g., via Bluetooth®. To this end, the wireless interface 124 could include a Bluetooth® antenna. Other wireless communication interfaces, e.g., WiFi®, are also possible. The wireless interface 124 may also be configured to communicate wirelessly with a remote server.

The electrical interface 130 of the device 102 may include one or more electrical contacts. The electrical interface 130 may be located in a base of the cavity formed in the upper end 108 of the device 102. When the device 102 is physically coupled to the consumable component 104, the electrical interface 130 of the device 102 is configured to transfer electrical power from the power source 118 to the consumable component 104 (i.e., upon activation of the smoking substitute system 100).

The electrical interface 130 may be configured to receive power from a charging station when the device 102 is not physically coupled to the consumable component 104 and is instead coupled to the charging station. The electrical interface 130 may also be used to identify the consumable component 104 from a list of known consumables. For example, the consumable component 104 may include e-liquid having a particular flavour and/or having a certain concentration of nicotine (which may be identified by the electrical interface 130). This can be indicated to the controller 120 of the device 102 when the consumable component 104 is connected to the device 102. Additionally, or alternatively, there may be a separate communication interface provided in the device 102 and a corresponding communication interface in the consumable component 104 such that, when connected, the consumable component 104 can identify itself to the device 102.

The additional components 138 of the device 102 may comprise an indicator (e.g., the light 116 discussed above), a charging portion, a battery charging control circuit, a sensor or, e.g., user input.

The charging port 115 (e.g., USB or micro-USB port) may be configured to receive power from the charging station (i.e., when the power source 118 is a rechargeable battery). This may be located at the lower end of the device 102. Alternatively, the electrical interface 126 discussed above may be configured to act as a charging port configured to receive power from the charging station such that a separate charging port is not required.

The battery charging control circuit may be configured for controlling the charging of the rechargeable battery. However, a battery charging control circuit could equally be located in the charging station (if present).

The sensor may be, e.g., an airflow (i.e., puff) sensor for detecting airflow in the smoking substitute system 100, e.g., caused by a user inhaling through a mouthpiece attachment (not shown) fitted to the outlet portion 109 of the consumable component 104. The smoking substitute system 100 may be configured to be activated when airflow is detected by the airflow sensor. This sensor could alternatively be included in the consumable component 104. The airflow sensor can be used to determine, for example, how heavily a user draws on the outlet portion 109 (through the affixed or integral mouthpiece) or how many times a user draws on the outlet portion 109 in a particular time period.

The user input may be a button. The smoking substitute system 100 may be configured to be activated when a user interacts with the user input (e.g., presses the button). This provides an alternative to the airflow sensor as a mechanism for activating the smoking substitute system 100.

The consumable component 104, which is shown in FIG. 2B, includes the tank 106, an electrical interface 130, a vaporiser 132, an air inlet 134, an air outlet 136 (e.g., formed in the outlet portion 109), and one or more additional components 138

The electrical interface 130 of the consumable component 104 may include one or more electrical contacts. The electrical interface 126 of the device 102 and the electrical interface 130 of the consumable component 104 may be configured to contact each other and thereby electrically couple the device 102 to the consumable component 104 when the base portion 111 of the consumable component 104 is inserted into the cavity formed in the upper end 108 of the device 102 (as shown in FIG. 1A). In this way, electrical energy (e.g., in the form of an electrical current) is able to be supplied from the power source 118 in the device 102 to the vaporiser 132 in the consumable component 104.

The vaporiser 132 is configured to heat and vaporise e-liquid contained in the tank 106 using electrical energy supplied from the power source 118. As will be described further below, the vaporiser 132 heats the e-liquid received from the tank 106 to vaporise the e-liquid. The air inlet 134 is configured to allow air to be drawn into the smoking substitute system 100 when a user inhales using the air outlet 136 formed in the outlet portion 109, such that the vaporised e-liquid is drawn through the consumable component 104 for inhalation by the user.

In operation, a user activates the smoking substitute system 100, e.g., through interaction with a user input forming part of the device 102 or by inhaling through the air outlet 136 as described above. Upon activation, the controller 120 may supply electrical energy from the power source 118 to the vaporiser 132 (via electrical interfaces 126, 130), which may cause the vaporiser 132 to heat e-liquid drawn from the tank 106 to produce a vapour which is inhaled by a user through the mouthpiece which is affixed to or integral with the outlet portion 109.

An example of one of the one or more additional components 138 of the consumable component 104 is an interface for obtaining an identifier of the consumable component 104. As discussed above, this interface may be, for example, an RFID reader, a barcode, a QR code reader, or an electronic interface which is able to identify the consumable component 104. The consumable component 104 may, therefore include any one or more of an RFID chip, a barcode or QR code, or memory within which is an identifier and which can be interrogated via the electrical interface 126 in the device 102.

It should be appreciated that the smoking substitute system 100 shown in FIGS. 1A to 2B is just one exemplary implementation of a smoking substitute system 100. For example, the system could otherwise be in the form of an entirely disposable (single-use) system or an open system in which the tank is refillable (rather than replaceable).

Figure 3:
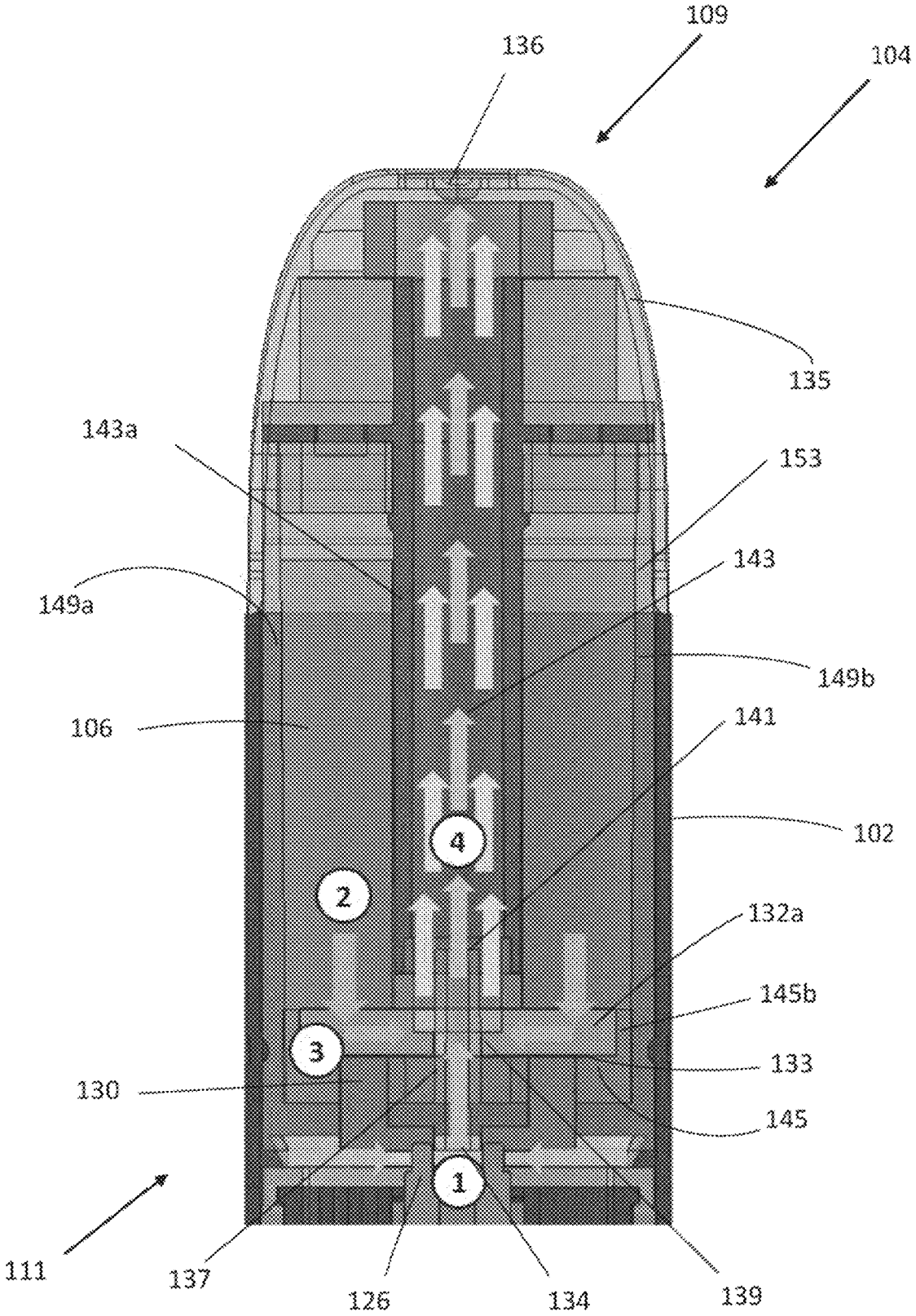
FIG. 3 is a first example of a consumable component.

FIG. 3 shows a first example of a consumable component 104 within the cavity of a device 102.

The consumable component 104 comprises a vaporiser 132 which is formed of a planar ceramic substrate 132*a* with a metal heating track 132*b* screen printed onto the upstream surface 133 of the substrate 132*a*.

The consumable component 104 has a linear, axial airflow path extending from a centrally positioned upstream air inlet 134 to a downstream air outlet 136 provided in a mouthpiece portion 135 provided at the outlet portion 109 of the component 104.

The air inlet 134 is formed in a base 145 and a metal air tube 137 extends from the base 145 in fluid communication with the air inlet 134.

The air tube 137 passes through a longitudinal through hole 139 in the substrate 132*a* so that the outlet 141 of the air tube 137 is downstream of the vaporiser 132.

The component further comprises a conduit 143 which extends from proximal the vaporiser 132 to the outlet portion 109 of the component 104. The outlet 141 of the air tube 137 is within the conduit 143, i.e., a downstream portion of the air tube 137 extends concentrically within an upstream portion of the conduit 143.

The component has a housing 153 comprising laterally opposed first and second side walls 149*a*, 149*b*.

The housing 153 further comprises opposing front and rear walls (not shown) spaced by the laterally opposed first and second side walls 149*a*, 149*b*. The distance between the first and second side walls 149*a*, 149*b* of the housing 153 may define a width of the housing 153. The distance between the front and rear walls may define a depth of the housing 153. The width of the housing 153 is greater than the depth of the housing 153. The length of the housing 153 may be greater than the width of the housing 153. The depth of the housing 153 may be smaller than each of the width and the length.

The conduit 143 is substantially parallel to the first and second side walls 149*a*, 149*b* of the housing 153.

The component 104' comprises a tank 106 housing the liquid aerosol precursor (e-liquid).

The tank 106 (e.g., an outer region of the tank 106) is defined between the first and second side walls 149*a*, 149*b* and the front/rear walls.

The conduit 143 extends through the tank 106 with the conduit walls 143*a* defining an inner region of the tank 106.

The substrate 132*a* extends transversely across component between the first and second side walls 149*a*, 149*b* of the housing 153. It also extends between the front and rear walls of the housing 153.

A lower end of the tank 106 is in fluid communication with the substrate 132*a* such that e-liquid from the tank can permeate the substrate 132*a*.

The substrate 132*a* is supported on a support surface of the base 145. The base 145 also comprises a sleeve portion 145*b* upstanding from the support surface which abuts the perimeter of the substrate 132*a*. The sleeve portion 145*b* further seals against the side walls 149*a*, 149*b* and front/rear walls of the component housing 153.

The consumable component 104 comprises an electrical interface 130 for interfacing with a corresponding electrical interface 126 of the device 102. The electrical interface 130 includes two electrical contacts which extend through the base 145 to make contact with corresponding electrical contacts 126 in the device 102.

In use, power is supplied to the heating track 132*b* via the electrical contacts of the component electrical interface 130. This heats the upstream surface 133 of the substrate 132*a* so that e-liquid contained within the substrate 132*a* at the upstream surface 133 is vaporised.

The airflow path comprises a first portion extending from the air inlet 134 to the inlet of the air tube 137, i.e., extending through the base 145 from the air inlet 134 to the inlet of the air tube 137. A second (vaporiser) portion of the airflow path extends within the air tube 137 (from the air tube inlet to the air tube outlet 141) and a third portion extends from the air tube outlet 141 to the air outlet 136 (through the conduit 143).

Upon inhalation by the user, air flow is pulled through the air inlet 134 via two side air inlets (not shown) provided in the device. The air passes through the air tube 137 to the outlet 141 of the air tube.

As the airflow continues from the outlet 141 of the air tube 137 to the air outlet 136, vaporised e-liquid in pulled into the airflow path downstream of the air tube outlet 141 towards the air outlet 136 for inhalation by the user By providing the air tube 137 which defines the airflow path past the vaporiser and has an outlet 141 downstream of the vaporiser 132, unvaporised e-liquid from the vaporiser 132 is less likely to pass to and thus out of the air inlet 134 thus reducing leakage and user contamination.

Figure 4A:
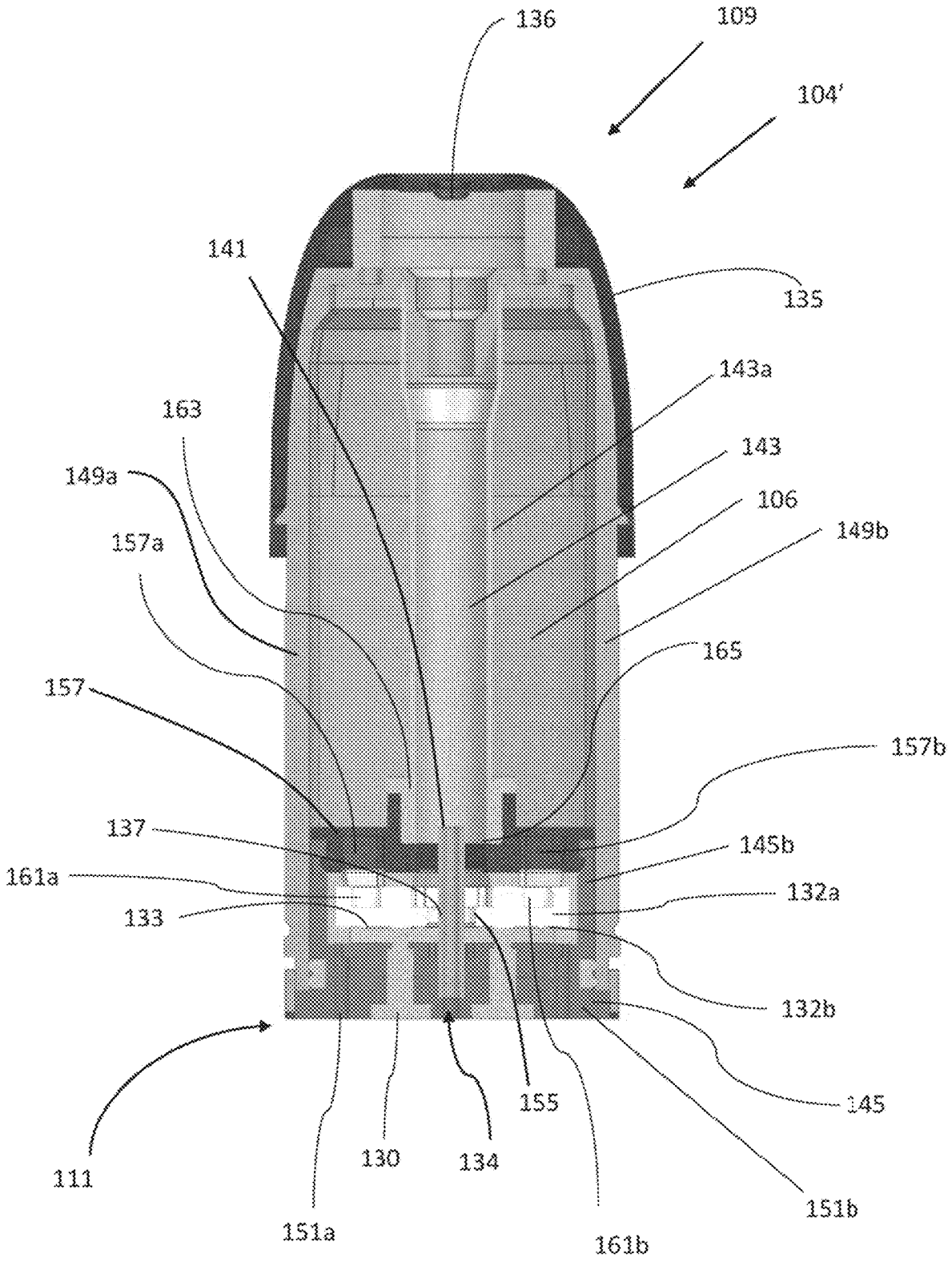
FIG. 4A is a second example of a consumable component.
Figure 4B:
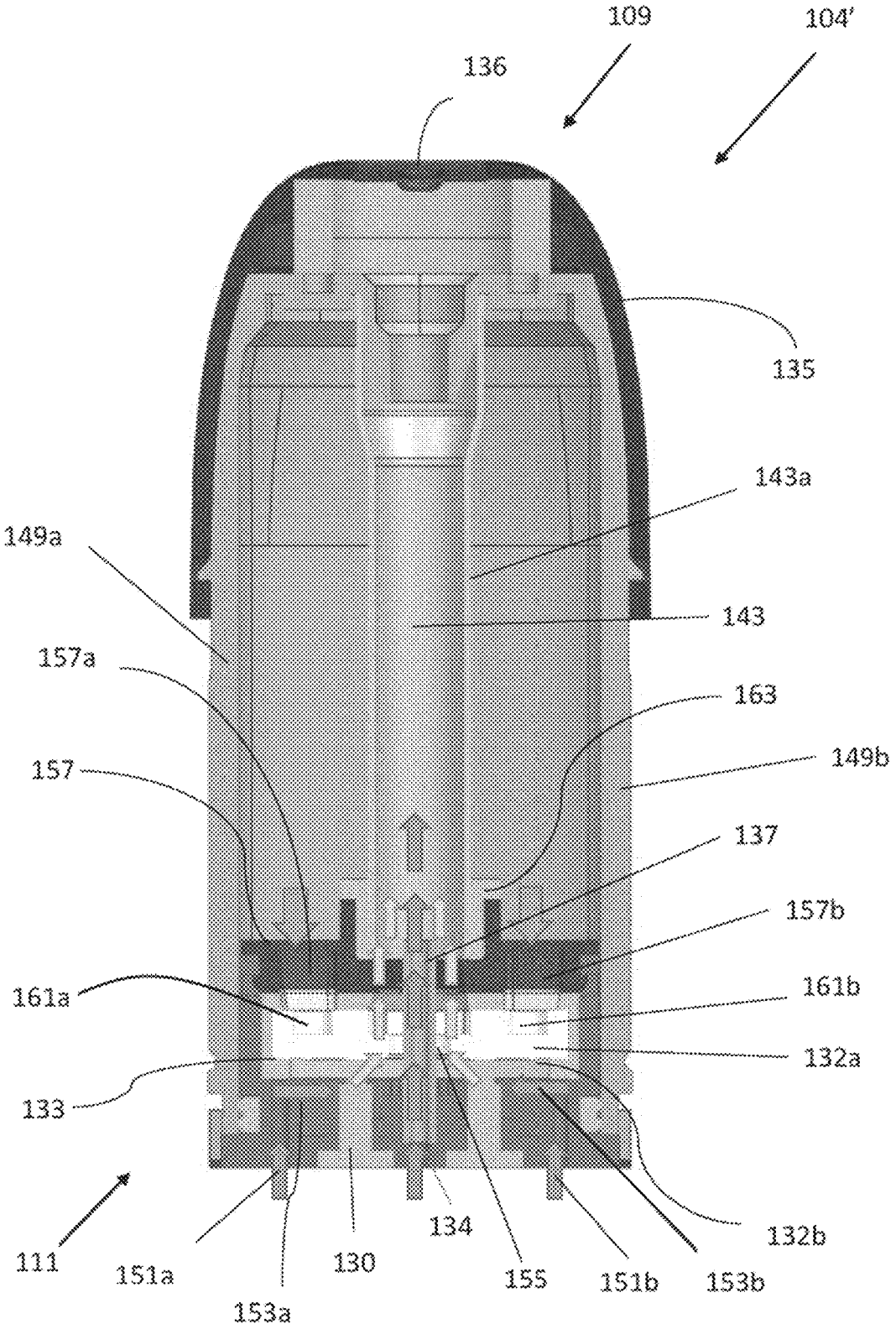
FIG. 4B shows the airflow path in the second example.

FIGS. 4A and 4B show a further example of a consumable component 104' which is similar to the first example (and uses common reference numerals).

The component 104' further comprises two further air inlets 151*a*, 151*b* which are diametrically opposed across the central air inlet 134.

As shown in FIG. 4B, there are two further air flow paths each comprising a radial portion 153*a*, 153*b* that extends along the upstream surface 133 of the vaporiser substrate 132*a*. Thus, in use, e-liquid is entrained in the radial portions 153*a*, 153*b* of the further air flow paths.

The further air flow paths each comprise a vaporiser portion that passes through an annular gap 155 in the substrate 132*a* around the air tube 137.

The component 104' further comprises a sealing plate 157 with the substrate 132*a* interposed between the base 145 and the sealing plate 157.

The sealing plate 157 seals against the walls 149*a*, 149*b* of the housing 153 to form the lower end of the tank 106. It engages with the sleeve portion 145*b* of the base 145. The sealing plate 157 comprises two feed channels 157*a*, 157*b* in fluid communication with the tank 106 and extending to the substrate 132*a* to provide the e-liquid to the substrate 132*a*. The downstream surface of the substrate 132*a* comprises two wells 161*a*, 161*b* in fluid communication with a respective feed channel 157*a, b* for pooling of e-liquid in the substrate.

The sealing plate 157 furthers comprise a gasket 163 for sealing against the conduit 143 proximal a conduit opening 165.

The further airflow paths join the airflow path downstream of the outlet 141 of the air tube 137.

In this way, the (cooler) air from the air tube 137 will mix with the (hotter) vapour-laden air from the further airflow path and this may impact, e.g., increase, the particle size within the resulting aerosol for inhalation at the air outlet 136.

While exemplary embodiments have been described above, many equivalent modifications and variations will be apparent to those skilled in the art when given this disclosure. Accordingly, the exemplary embodiments set forth above are considered to be illustrative and not limiting.

Throughout this specification, including the claims which follow, unless the context requires otherwise, the words "have", "comprise", and "include", and variations such as "having", "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means, for example, +/−10%.

The words "preferred" and "preferably" are used herein refer to embodiments of the disclosure that may provide certain benefits under some circumstances. It is to be appreciated, however, that other embodiments may also be preferred under the same or different circumstances. The recitation of one or more preferred embodiments therefore does not mean or imply that other embodiments are not useful, and is not intended to exclude other embodiments from the scope of the disclosure, or from the scope of the claims.

What is claimed is:

1. An aerosol-delivery component comprising: a vaporiser and having an airflow path extending from at least one upstream air inlet to a downstream air outlet, wherein the airflow path comprises a vaporiser portion extending past the vaporiser, the vaporiser portion of the airflow path being at least partly defined by an air tube, the air tube having an inlet and an outlet, the inlet of the air tube in fluid communication with the at least one upstream air inlet, wherein the outlet of the air tube is downstream of the vaporiser such that the air tube physically separates the vaporiser portion of the airflow path from the vaporiser.

2. A component according to claim 1 further comprising a conduit extending towards the air outlet from a conduit opening proximal the vaporiser.

3. A component according to claim 2 wherein the air tube extends concentrically within the conduit.

4. A component according to claim 1 wherein the vaporiser comprises a planar porous substrate.

5. A component according to claim 4 wherein the substrate is a ceramic substrate.

6. A component according to claim 4 wherein the substrate comprises a longitudinal through hole and the air tube passes through the longitudinal through hole.

7. A component according to claim 6 further comprising at least one further air inlet and at least one further airflow path wherein the or each further airflow path comprises a vaporiser portion extending through the substrate.

8. A component according to claim 7 wherein the or each vaporiser portion extends through a gap provided around the air tube within the longitudinal through hole.

9. A component according to claim 7 wherein the vaporiser comprises a heating track and wherein the or each further airflow path comprises a radial portion extending adjacent the heating track.

10. A component according to claim 9 wherein the heating track is provided on an upstream face of the substrate and the radial portion of the at least one further air flow path passes over the upstream face of the substrate.

11. A component according to claim 1 further comprising a base supporting the vaporiser, the at least one air inlet being provided in the base.

12. A component according to claim 11 further comprising a sealing plate with the vaporiser interposed between the base the sealing plate.

13. A component according to claim 12 wherein the sealing plate comprises at least one feed channel in fluid communication with a tank for containing an aerosol precursor, for delivering aerosol precursor to the vaporiser.

14. A component according to claim 1 which is a consumable component for receipt in a smoking substitute device.

15. An aerosol-delivery system comprising a component according to claim 1 and a device comprising a power source.

* * * * *